US005170905A

United States Patent [19]

Luch

[11] Patent Number: 5,170,905

[45] Date of Patent: Dec. 15, 1992

[54] TAMPER-EVIDENT THIN-WALLED CONTAINER PACKAGE

[75] Inventor: Daniel Luch, Los Gatos, Calif.

[73] Assignee: Cap Snap Co., San Jose, Calif.

[21] Appl. No.: 731,547

[22] Filed: Jul. 17, 1991

[51] Int. Cl.[5] ..... B65D 17/40; B65D 41/32

[52] U.S. Cl. ..... 220/276; 220/265; 220/270; 220/306; 220/356

[58] Field of Search ..... 220/276, 265, 270, 306, 220/354, 356

[56] References Cited

U.S. PATENT DOCUMENTS

| | | | |
|---|---|---|---|
| 3,672,528 | 6/1972 | Faulstich . | |
| 3,716,612 | 2/1973 | Botkin . | |
| 3,817,420 | 6/1974 | Heisler . | |
| 3,840,152 | 10/1974 | Hodge . | |
| 3,841,512 | 10/1974 | Botkin . | |
| 3,858,748 | 1/1975 | Marco | 220/276 |
| 3,940,004 | 2/1976 | Faulstich | 215/256 |
| 4,024,976 | 5/1977 | Acton | 220/276 X |
| 4,111,329 | 9/1978 | Lampman | 220/266 |
| 4,190,175 | 2/1980 | Allen | 220/270 |
| 4,296,871 | 10/1981 | Andersson | 220/306 |
| 4,335,827 | 6/1982 | Knize et al. | 220/284 |
| 4,422,559 | 12/1983 | Landis | 220/306 |
| 4,520,943 | 6/1985 | Nielsen | 220/281 |
| 4,711,364 | 12/1987 | Letica | 220/276 |
| 4,790,448 | 12/1988 | Ostrum et al. | 220/270 |
| 4,819,825 | 4/1989 | Landis | 220/276 |
| 4,934,554 | 6/1990 | Edwards | 220/266 |
| 4,966,292 | 10/1990 | Marino | 220/270 X |
| 5,027,969 | 7/1991 | Lesquir | 220/270 |

*Primary Examiner*—Allan N. Shoap
*Assistant Examiner*—Vanessa Caretto
*Attorney, Agent, or Firm*—Julian Caplan

[57] ABSTRACT

A thin walled container of the type used to package dairy products such as yogurt, cottage cheese and other products is provided with an out-turned serrated container lip surrounded by an outward-spaced tamper-evident band, the lower edge of which is connected to the container by plural frangible bridges. The closure has a flange having an in-turned locking bead which engages the container lip and is held in place by the tamper-evident band. To open the container, the tamper-evident band is torn away by breaking the bridges, whereupon the closure may be separated from the container lip.

26 Claims, 4 Drawing Sheets

TAMPER-EVIDENT THIN-WALLED CONTAINER PACKAGE

BACKGROUND OF THE INVENTION

1. Field of the Invention

This invention relates to a new and improved tamper-evident thin-walled container package. More particularly, the invention relates to a container and a closure for said container and the combination of the container and closure. The container is of the general type used to package dairy products such as yogurt, cottage cheese and the like.

2. Description of Related Art

Cups, tubs and other packages for dairy foods closed by lids are well known in the art. Heretofore, some of these containers have been made tamper-evident either by a thermally applied adhesive foil fitting over the lip of the container or a band of heat shrink film around the down-turned peripheral flange of the lid. These techniques are expensive, reduce packaging speeds and are not efficient. Thermally applied adhesive foils are not suitable for re-closure unless accompanied by a re-closure lid. Heat shrink films are often difficult for the consumer to remove.

Attempts have been made to supply tamper-evident features by mechanical means. However, the fact that the containers are generally of large diameter and thin-walled allows them to be easily distorted. The ease of distortion has prevented mechanical tamper-evident concepts from being effective.

Most current dairy containers are made either by thermoforming or injection molding of a suitable material such as polystyrene, polyethylene or polypropylene. The present invention provides a simple and cost effective tamper-evident package by combining a novel injection molded, thin-walled container with a complementary lid.

SUMMARY OF THE INVENTION

The container of the present invention generally has an out-turned lip projecting from the container wall. Spaced outwardly and surrounding the lip is a circular, tamper-evident band connected integrally to the container by a plurality of angularly spaced frangible bridges. The lid comprises a top disk which fits over the top of the container and preferably has a downturned outer skirt which fits between the container wall and the tamper evident band and which is formed with beads which engage below the lip of the container. The lid skirt fits between the lip and the tamper-evident band. So long as the band is intact, the lid cannot be removed because one cannot obtain access to the lid to pry it off. If an attempt is made to remove the lid without removing the band, some or all of the frangible bridges will be broken, providing evidence of tampering activity. When the band is intentionally removed after breaking the frangible bridges, the lid may be lifted off the container.

In other modifications of the invention the container is formed with an outward spaced downward extending skirt depending from the lip and the tamper evident band is connected thereto by frangible bridges. The outer skirt of the lid fits between the outer skirt of the container and the tamper evident band and engages the latter with cooperating bead means.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
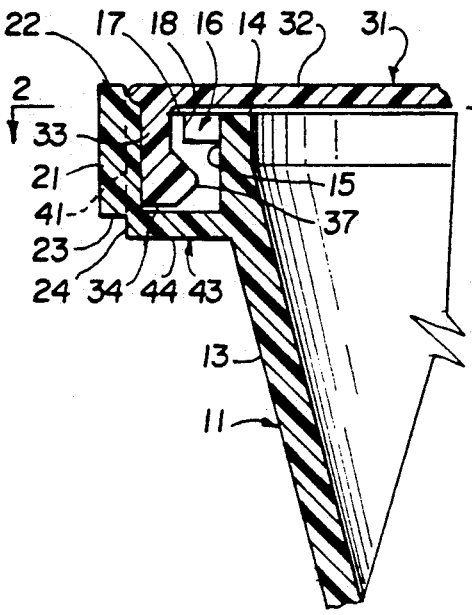
FIG. 1 is a fragmentary sectional view through the upper portion of a container with the closure applied thereto as viewed approximately along the line 1—1 of FIG. 2.

Container 11 is a cup or tub used to package dairy products and the like and for other uses characterized by the fact that the walls of the container are relatively thin and are molded of a flexible plastic material such as polystyrene, polyethylene or polypropylene. The shape of the container 11 shown in FIGS. 1-5 is subject to considerable variation. As shown, container 11 has a bottom 12 and sidewalls 13 here shown as sloping outwardly-upwardly and terminating in a substantial horizontal top edge 14. A peripheral lip 16 is formed immediately below top edge 14 and said lip can be formed with serrations 17 separated by gaps 18. This geometry affords flexibility to the lip and also permits mold construction without slides. Further to this purpose, the outer surface 15 of sidewall 13 near the top is substantially vertical. Surrounding the lip 16 and spaced outwardly therefrom is a vertical tamper-evident band 21 having upper edge 22 and lower edge 23. In the embodiment of FIG. 1, the upper edge 22 is at a higher elevation than the top edge 14 and the lower edge 23 extends below the lip 16. On the inner surface of tamper-evident bands 21 at angularly-spaced intervals are pluralities of vertical internal ribs 41, here shown as two in number, which are in close proximity to the skirt 33 of lid 31 when the lid is applied to the container.

Figure 2:
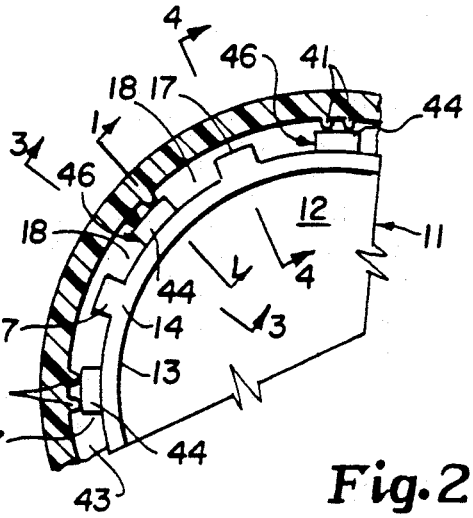
FIG. 2 is a fragmentary horizontal sectional view of the container, taken substantially along line 2—2 of FIG. 1 with cap removed.
Figure 3:
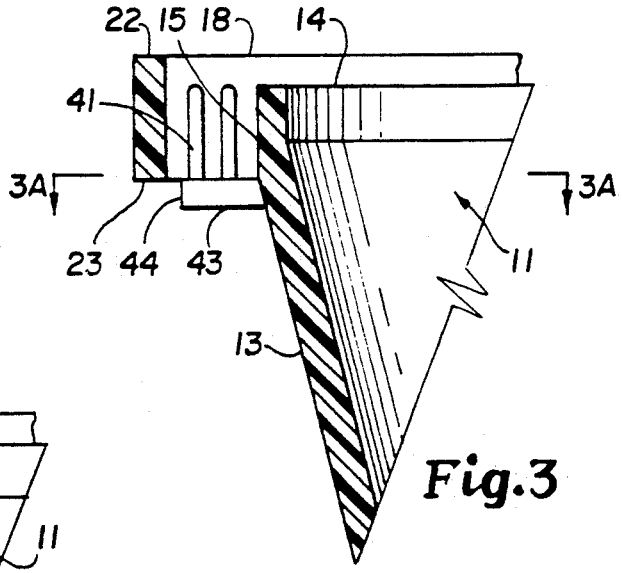
FIGS. 3 and 4 are fragmentary sectional views taken substantially along the lines 3—3 and 4—4, respectively, of FIG. 2.
Figure 4:
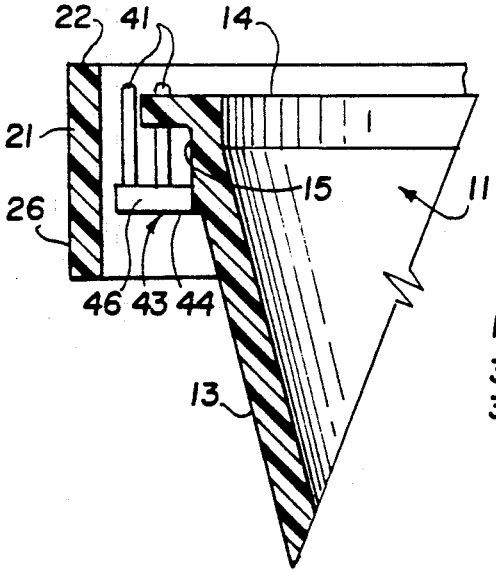
Figure 5:
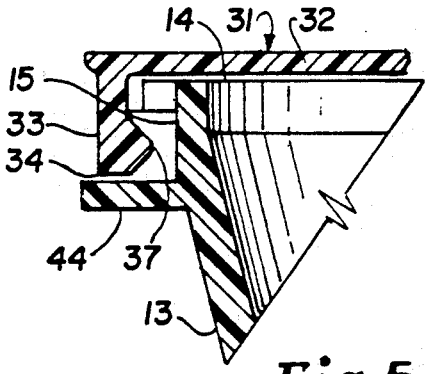
FIG. 5 is a view similar to FIG. 1 with the tamper-evident band removed.
Figure 6:
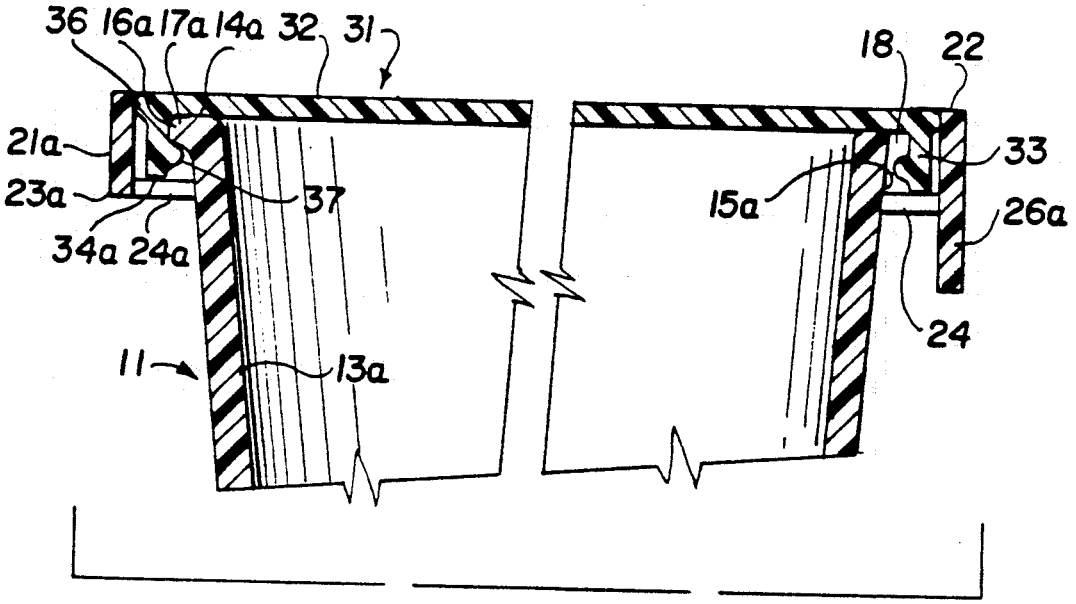
FIG. 6 is a fragmentary sectional view through the upper portion of a modified container with the closure applied thereto.
Figure 7:
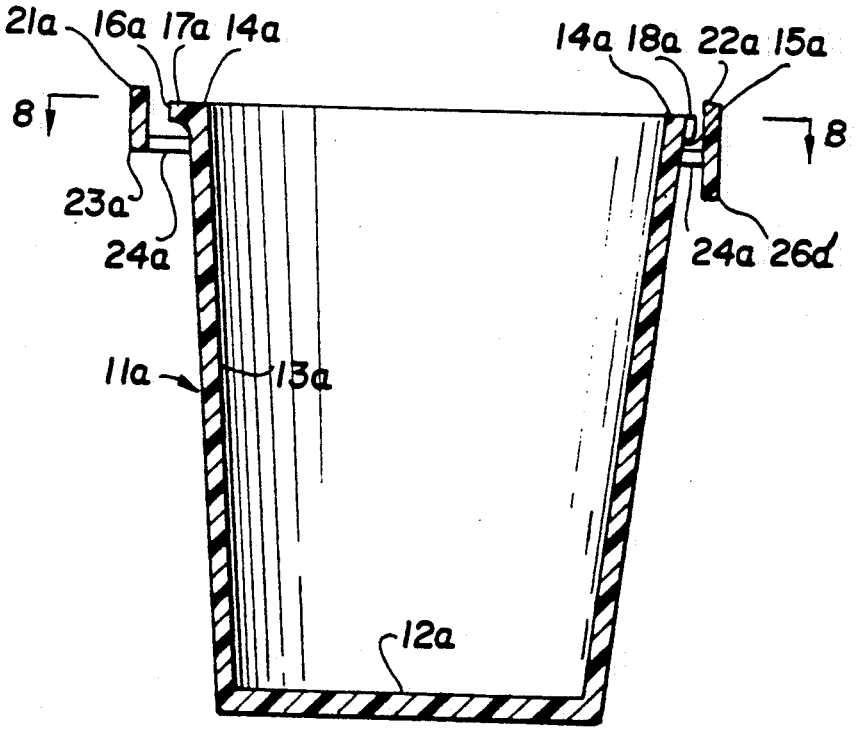
FIG. 7 is a vertical sectional view through the container of FIG. 6.
Figure 8:
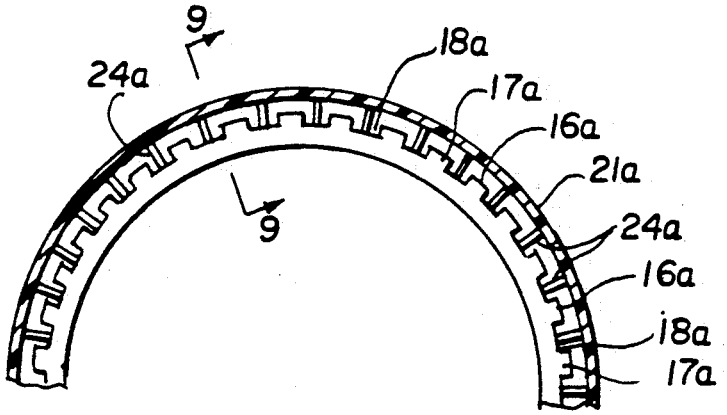
FIG. 8 is a sectional view taken substantially along the line 8—8 of FIG. 7.
Figure 9:
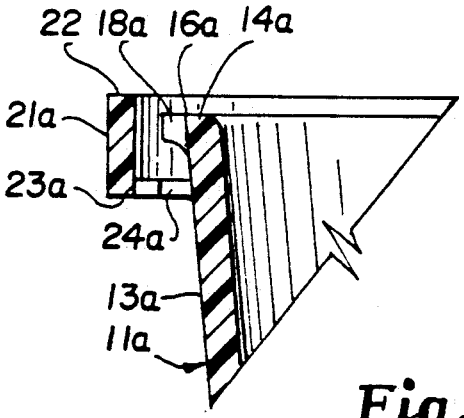
FIG. 9 is an enlarged sectional view taken substantial along the line 9—9 of FIG. 8.
Figure 3A:
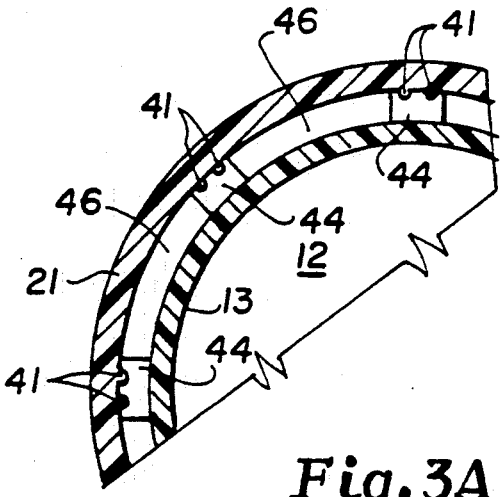
FIG. 3A is a fragmentary horizontal sectional view taken substantially along line 3A—3A of FIG. 3.
Figure 10:
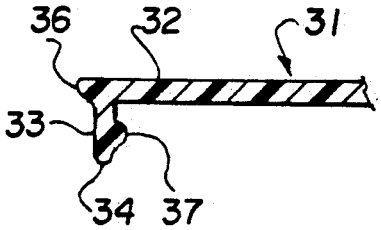
FIG. 10 is an enlarged sectional view through a portion of the lid of FIGS. 1 and 6.

A relatively rigid, segmented, horizontal platform 43 extends outward from sidewalls 13 at a level such that its top surface is approximately at the level of the lower edge 23 of band 21. Platform 43 consists of segments 44 separated by gaps 46. As shown in FIG. 2, segments 44 are aligned with gaps 18 and gaps 46 with serrations 17. The lower ends of ribs 41 join the outer edges of platform segments 44 in bridges 24. A tear tab 26 is joined in at least one location to the lower edge of band 21. It will be understood that such tab may be joined to the upper edge of band 21. The user may grip tab 26 and pull upward, thereby sequentially breaking bridges 24 so that band 21 may be removed.

Lid 31 is the closure for container 11 and has top disk 32 which extends out beyond lip 16 and is formed with a vertical downward extending skirt 33 having its bottom edge above the bridges 24 as initially applied to the container. It will be noted that the top edge 22 of tamper-evident band 21 is about level with the upper surface of disk 32. Skirt 33 has an inward extending bead 37 at its bottom, said bead locking under serrations 17 of lip 16.

To assemble the lid 31 on the container 11, after the latter has been filled, the disk 32 is pressed downward. Bottom edge 34 fits between the band 21 and the lip 16 and downward pressure on the container causes sufficient deformation of lip 16 and skirt 33 so that the internal bead 37 slips down over lip 16 and locks thereunder, while the outside of skirt 33 is positioned in close proximity to the inside of the band 21.

As assembled, one cannot gain ready access to the lid 31 to remove it because it is closely surrounded and encased by the tamper-evident band 21. If one were to attempt to remove the lid 31 by excessive force, bridges 24 would be broken and evidence of tampering would be apparent. When it is necessary to open the container, the user pulls on the tab 26 causing the bridges 24 to break off and permitting the band 21 to be lifted away from the lid. After band 21 has been removed, the user may insert a thumb or finger in one of the gaps 46 in platform 43 and pull up on bottom edge 34 of lid 31 to remove the lid. For such purpose, gap 46 is sufficiently wide (e.g., ½ inch) so that a finger may be inserted.

FIGS. 6–9 illustrate a modification of the structure of FIGS. 1–5. For such purpose, the ribs 41 are eliminated and the platform 43 considerably modified. Thus, lower edge 23*a* of band 21*a* is joined to walls 13*a* by a plurality of angularly spaced apart, radial, frangible bridges 24*a*.

Figure 11:
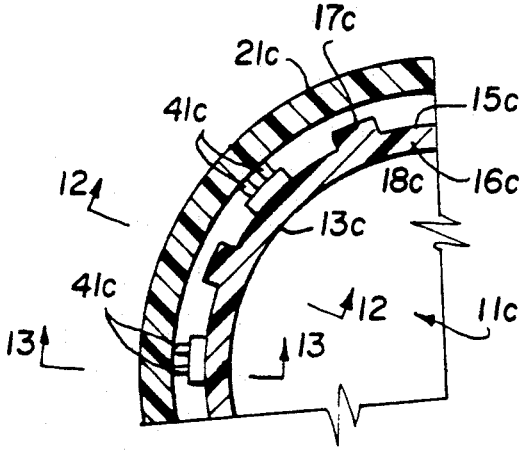
FIG. 11 is a view similar to FIG. 2 of a modified container.
Figure 12:
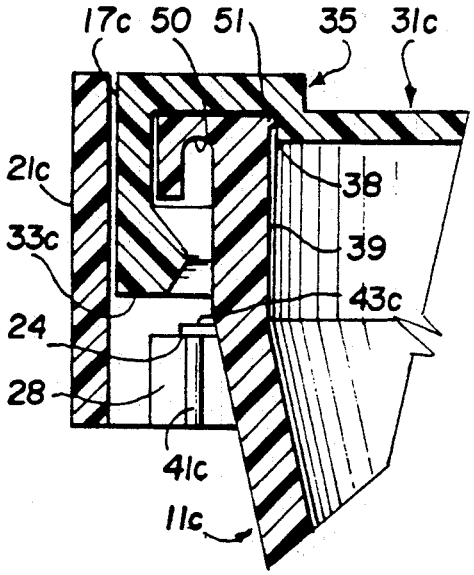
FIGS. 12 and 13 are fragmentary sectional views taken substantially along the lines 12—12 and 13—13, respectively with closure applied.
Figure 13:
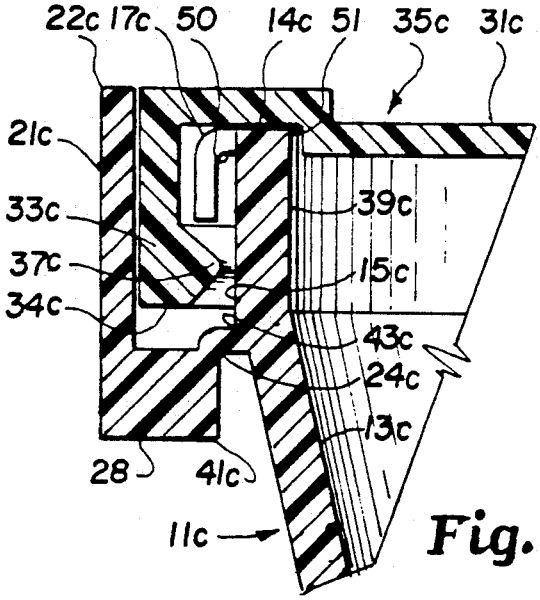
Figure 14:
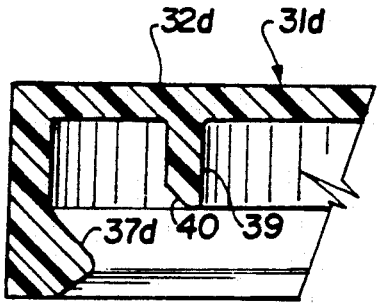
FIG. 14 is a fragmentary sectional view of a further modified lid.

FIGS. 11, 12 and 13 illustrate a further modification of the structure previously described. The lid 31*c* shown as applied to the container in FIGS. 12 and 13 has a central depression 35 which serves two purposes. First, packages can be readily stacked by placing container bottom 12 into depression 35 of another container lid. Second, the depression forms an effective inner skirt 38 which can form a seal with the inner wall 39 of the container. The container shown in FIGS. 12 and 13 also has an inner lip 51 which promotes sealing contact with skirt 38. FIG. 14 shows a modified lid 31*d* having a flat top disk 32*d* with a depending inner skirt or plug 39 formed with a chamfer 40 on its lower edge.

Lip serration 17*c* is shown in FIG. 12 as being cored out, in core 50, similar to an inverted U. This structure allows the lip serration 17*c* to more easily flex during application of lid 31*c*, improves molding and saves material.

Rib 41*c* is attached to platform 43*c* through bridges 24*c* on the bottom side of platform 43*c*. With this arrangement, platform 43*c* need not be as pronounced. In addition, if one tries to remove the lid prior to removing the band, bridges 24*c* are in compression rather than tension and more effectively thwart the required upward movement. Finally, the design shown in FIG. 12 permits a snugger fit between skirt 33*c* and outer tamper evident band 21*c*.

FIG. 14 shows a modified cap 31*d* which may be used with container 11*c*. Top disk 32*d* has an inner skirt or plug 39 which may fit inside the inner wall 39*c* of container 11*c* shown in FIG. 13, making it unnecessary to depress central panel 31*c* of cap 35*c* shown in FIG. 13.

Figure 15:
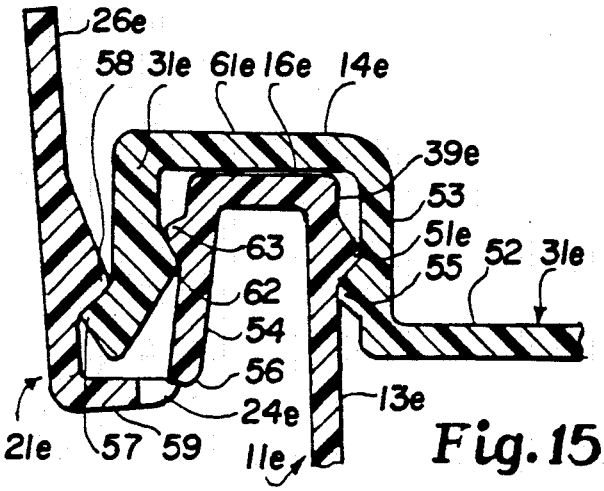
FIG. 15 is a view similar to FIG. 1 of a modified container with closure applied.

FIG. 15 illustrates the presently-preferred embodiment of the invention. Container 11*e* has side walls 13*e* terminating in an annular top edge 14*e* from which extends lip 16*e*. Short outer skirt 54 having terminal edge 56 depends from lip 16*e*. Tamper evident band 21*e* is spaced outward of skirt 54, the lower edge of band 21*e* having an inward extending shoulder 59, the inner edge of which is joined to terminal edge 56 by a plurality of radially-spaced, frangible bridges 24*e* which form a circumferential line of weakness to allow band 21*e* to be separated from container 11*e* on initial opening. Upward extending tear tab 26*e* may be gripped and pulled by the consumer to remove band 21*e*.

Lid 31*e* of FIG. 15 comprises a depressed central panel 52 having an upward extending peripheral inner skirt 53 having at its upper edge an outward extending annular ring 61 spanning top edge 14*e* and lip 16*e* and having a downward extending outer skirt 31*e* interposed between skirt 54 and band 21*e* and terminating above shoulder 59.

Inner skirt 53 has an external bead 55 which locks under bead 51*e* near the top of the inner wall 13*e* and skirt 33*e* has an internal bead 62 which locks under external bead 63 on skirt 54. These beads secure lid 31*e* to container 11*e*. The sloping surfaces of the beads enables the lid 31*e* to snap on by direct downward pressure, the members deforming sufficiently to permit capping without fracture.

Skirt 33*e* has an external bead 57 which locks under internal bead 58 of band 21*e*. So long as bridges 24*e* are intact, shoulder 59 prevents using the fingers to pry up the lower edge of skirt 33*e* and thus remove the lid 31*e* and, further, beads 57 and 58 also hold lid 31*e* from being removed. Any attempt to tamper with the contents of the container is made evident by fracture of some or all bridges 24*e*.

When band 21*e* is removed, the user may pry lid 31*e* off by applying the fingers to the lower edge of skirt 33*e*, the beads 62 and 63 and beads 51*e* and 55 being so shaped that such removal is facilitated. The beads interengage for reclosure when the lid 31*e* is re-applied by direct downward pressure.

In many respects the structures of FIGS. 6–10, 11–13, 14 and 15 resemble those of the preceding modifications and the same reference numerals followed by subscripts a, c, d and e, respectively, designate corresponding parts.

In the foregoing description and in the following claims the container and lid are described as circular, cylindrical, ring, etc. It will be understood, however, that oval, rectangular and other shapes may be used, and the terms used are to be thus interpreted.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A container for use with a closure having a top having a periphery, a down-turned, cylindrical skirt having an interior and an exterior vicinal the periphery of the top and an internal bead on the interior of the skirt, said container having a circumferential wall terminating in a top edge, a lip extending outward of said wall vicinal said top edge positioned to lock over the bead of the closure when the closure is pushed vertically into sealing position with the container, said lip being formed with angularly spaced serrations with gaps between said serrations, a cylindrical tamper-evident band around and spaced outwardly of said lip positioned to fit around the outside of the skirt of the closure, said band having an upper edge and a lower edge and frangible means connecting said tamper-evident band to another portion of said container, a platform extending outward from said wall having an outer edge in proximity to said band, said frangible means joining said outer edge to said band, said platform being formed with segments separated by gaps, said upper edge of said band being at least as high as said lip, said serrations being angularly offset relative to said segments so that there are no lip serrations above any of said platform segments.

2. A container according to claim 1 in which said other portion of said container, said tamper-evident band and said frangible means are integral.

3. A container according to claim 1 in which said tamper-evident band has an upper edge elevated above said lip.

4. A container according to claim 1 which further comprises a tear tab connected to said tamper-evident band, whereby, when said tab is pulled, said frangible means are broken and said band may be removed.

5. A container according to claim 4 in which said tear tab extends below the lower edge of said band.

6. A container according to claim 4 in which said tear tab extends above the upper edge of said band.

7. A container according to claim 7 which further comprises a plurality of internal ribs on said band adjacent said segments, the lower edges of said ribs comprising said frangible means.

8. A container according to claim 1 in which said gaps are sufficient for entry of a finger to pry off said closure.

9. In combination a closure having a top a periphery and an upper surface, a down-turned, cylindrical skirt having an interior and an exterior vicinal the periphery of said top and an internal bead on the interior of said skirt, and a container having a circumferential wall terminating in a top edge, a lip extending outward of said wall vicinal said top edge positioned to lock over said bead when said closure is pushed vertically into sealing position with the container, said lip being formed with angularly spaced serrations with gaps between said serrations, a cylindrical tamper-evident band around and spaced outwardly of said lip positioned to fit around the exterior of said skirt, said band having a lower edge and an upper edge, and frangible means connecting said tamper-evident band to another portion of said container, a platform extending outward from said wall below said skirt having an outer edge in proximity to said band, said frangible means joining said outer edge to said band, said platform being formed with segments separated by gaps, said upper edge of said band being at least as high as said lip, said serrations being angularly offset relative to said segments so that there are no lip serrations above any of said platform segments.

10. The combination of claim 9 in which said other portion of said container, said tamper-evident band and said bridges being integral.

11. The combination of claim 9 in which said tamper-evident band has an upper edge elevated above said lip substantially co-planar with the upper surface of said top.

12. The combination of claim 9 which further comprises a tear tab connected to said tamper-evident band, whereby, when said tab is pulled, said frangible means is broken and said band may be removed from position around said skirt, thereby permitting removal of said closure.

13. The combination of claim 12 in which said tear tab extends below the lower edge of said band.

14. The combination of claim 9 in which said band has an interior, said skirt is formed with an external bead positioned to bear against said interior of said band.

15. A container according to claim 9 which further comprises a plurality of internal ribs on said band, said ribs having lower edges comprising said frangible means.

16. A combination according to claim 9 in which gaps are sufficient for entry of a finger to pry off said closure.

17. A container for use with a closure having a top having a periphery, a down-turned, cylindrical closure skirt having an interior and an exterior vicinal the periphery of the top and first bead means, said container having second bead means engageable with said first bead means, a circumferential wall terminating in a top edge, a lip extending outward of said wall vicinal said top edge, and said wall having an interior, a container skirt depending from said lip spaced outward of said circumferential wall, a tamper evident band disposed outward of said container skirt having a lower edge, said second bead means being engageable with said first bead means when said closure is assembled on said container to restrain removal of said closure so long as said tamper evident band is in place, a shoulder extending inward from said lower edge of said tamper evident band and frangible means connecting said shoulder to said container skirt, there being a substantially unobstructed space above said shoulder between said container skirt and said tamper-evident band.

18. A container according to claim 17 in which said second bead means is on the interior of said circumferential wall.

19. A container according to claim 17 in which said second bead means extends outwardly from said container skirt.

20. In combination, a closure comprising a top having a periphery, a first down-turned, cylindrical closure skirt having an interior and an exterior vicinal the periphery of said top and first bead means, and a container comprising second bead means engageable with said first bead means, a circumferential wall terminating in a top edge and having an interior, a lip extending outward of said wall vicinal said top edge, a container skirt depending from said lip spaced outward of said circumferential wall, a tamper evident band having a lower edge disposed outward of said container skirt, said second bead means being engageable with said first bead means when said closure is assembled on said container to restrain removal of said closure so long as said tamper evident band is in place, a shoulder extending inward from the lower edge of said tamper evident band and frangible means connecting said shoulder to said container skirt, there being a substantially unobstructed space above said shoulder between said container skirt and said tamper-evident band before said closure is assembled with said container.

21. The combination of claim 20 which further comprises third bead means on the interior of said circumferential wall engaging said closure.

22. The combination of claim 20 in which said closure top has an upward extending inner closure skirt having an interior, an annular ring extending outward of said inner closure skirt and resting on said lip, said first-mentioned closure skirt depending from said annular ring.

23. The combination of claim 22 in which said inner closure skirt has an exterior which further comprises third bead means on the interior of said circumferential wall and fourth bead means on the exterior of said inner closure skirt interengaging with said third bead means.

24. The combination of claim 22 in which said closure skirt has an interior and which further comprises third bead means on the exterior of said container skirt and fourth bead means on the interior of said closure skirt engaging with said third bead means.

25. The combination of claim 20 in which said first bead means are on said exterior of said closure skirt.

26. In combination, a closure comprising a top having a periphery, a down-turned cylindrical outer skirt depending from said top vicinal said peripheral having an interior and an exterior, and an inner skirt spaced inward of said outer skirt, and a container comprising a circumferential wall having an inner surface terminating at a top edge, a lip extending outward of said top edge, a container skirt depending from said lip spaced outward of said circumferential wall, a tamper-evident band disposed outward of said container skirt, frangible means connecting said tamper-evident band to said container skirt, the space above said frangible means being substantially unobstructed before said closure is applied to said container skirt, said tamper-evident band extending from below said lip to above said lip, said closure resting on said top edge and said outer skirt extending down between said container skirt and said tamper-evident band, said inner skirt contacting said inner surface of said circumferential wall to form a sealing engagement.

* * * * *